US006513500B2

(12) United States Patent
Braun et al.

(10) Patent No.: US 6,513,500 B2
(45) Date of Patent: Feb. 4, 2003

(54) FUEL RAIL DAMPING DEVICE

(75) Inventors: Charles W. Braun, Livonia, NY (US); Andrew S. Price, Webster, NY (US); Steven M. Curran, Hilton, NY (US); Michael A. Bradley, Rochester, NY (US); Peter E. Bartell, Fairport, NY (US); Kern E. Haynes, Rush, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/824,179

(22) Filed: Apr. 2, 2001

(65) Prior Publication Data

US 2002/0139351 A1 Oct. 3, 2002

(51) Int. Cl.[7] ..... F02M 55/04
(52) U.S. Cl. ..... 123/456; 138/30
(58) Field of Search ..... 123/456, 467; 138/30

(56) References Cited

U.S. PATENT DOCUMENTS

| | | | | | |
|---|---|---|---|---|---|
| 4,729,360 | A | * | 3/1988 | Fehrenbach et al. | 123/456 X |
| 5,516,266 | A | * | 5/1996 | Talaski | 417/540 |
| 5,617,827 | A | | 4/1997 | Eshleman et al. | |
| 6,148,798 | A | * | 11/2000 | Braun et al. | 123/467 |
| 6,205,979 | B1 | * | 3/2001 | Sims, Jr. et al. | 123/456 |
| 6,314,942 | B1 | * | 11/2001 | Kilgore et al. | 123/467 |
| 6,418,909 | B2 | * | 7/2002 | Rossi et al. | 123/456 |

* cited by examiner

*Primary Examiner*—Tony M. Argenbright
(74) *Attorney, Agent, or Firm*—Patrick M. Griffin

(57) ABSTRACT

A fuel rail damper includes a hollow member having a first end and a second end, opposing first and second sides, and a first face and a second face interconnecting and spacing apart the first and second sides. Each of the first and second ends are sealed in an air tight manner to thereby define a chamber in conjunction with the first and second sides and the first and second faces.

20 Claims, 2 Drawing Sheets

FUEL RAIL DAMPING DEVICE

TECHNICAL FIELD

The present invention relates to fuel rails and, more particularly, to fuel rail damping devices.

BACKGROUND OF THE INVENTION

In modern internal combustion engines, fuel injection systems typically include a plurality of fuel injectors. A fuel rail supplies fuel to the fuel injectors. A typical fuel rail will include several sockets, within each of which is mounted a fuel injector. Thus, multiple fuel injectors typically share and are supplied with fuel by a common fuel rail. The injectors are sequentially actuated to deliver fuel from the fuel rail to the inlet port of a corresponding engine cylinder according to and in sequence with the operation of the engine. The sequential operation of the fuel injectors induce variations in pressure and pressure pulsations within the common fuel rail. The pressure pulsations within the fuel rail can result in undesirable conditions, such as fuel line hammer and maldistribution of fuel within the fuel rail.

U.S. Pat. No. 5,617,827, the disclosure of which is incorporated herein by reference, discloses a fuel rail that includes a conventional fuel rail damper. Conventional fuel rail dampers are typically formed from two thin stainless steel walls or shells, which are joined together in an air and liquid tight manner. Once joined together, the shells define a plenum therebetween. The material from which the shells or walls are constructed must be impervious to gasoline, and the shells must be hermetically sealed together. The shells or walls must have substantially flat sides that flex in response to rapid pressure fluctuations within the fuel rail. The flexing of the shells absorbs energy from the pressure pulsation to thereby reduce the speed of the pressure wave and the amplitude of the pressure pulsation/spike.

The two shells of a conventional fuel rail damper are typically sealed together through welding. More particularly, the two shells typically include a respective flange disposed generally around the periphery of the shells. The entire periphery of the flanges must then be welded together to thereby hermetically seal the shells together. The surface area that requires welding is therefore relatively substantial, and thus the welding operation is time consuming. A single imperfection in the welded periphery results in an plenum that is not properly sealed, and thus a defective fuel rail damper. Further, the welding operation causes a divergence of the flanges above or outside of the weld relative to the plenum, which potentially contributes to subsequent interferences between the damper and associated holders which orient and retain the damper in place within the fuel rail. Thus, at times, assembly of the damper into the fuel rail is rendered problematic. Moreover, the flanged shape of damper walls or shells that is needed to facilitate the welding operation reduces the effective surface area of the damper, and thus reduces the functional surface area thereof.

The shells or walls from which the fuel rail damper is constructed are typically flat stainless steel or metal pieces, which are then stamped to the proper shape and to form the flange. The faces of the shells or walls must be substantially flat, generally within approximately 0.5 mm. Most stamping processes are not capable of repeatedly and efficiently producing parts in conformance with such a flatness requirement, and thus waste and inefficiency result.

When exposed to sufficiently high pressure pulsations, the faces of the shells or walls approach their elastic or compliant limits and may contact each other or collapse. Due to the exposure to such high pressure pulsations, creases may form along the approximate center of the faces or shells. The creases may result in an eventual yielding of one or both of the shells. Further, such creases may facilitate the development of leaks and thereby destroy the function of the fuel rail damper.

Therefore, what is needed in the art is a fuel rail damper that does not require a weld around the entire periphery thereof in order to define and seal the plenum.

Furthermore, what is needed in the art is a fuel rail damper that is constructed in a manner that reduces susceptibility to leaks.

Still further, what is needed in the art is a fuel rail damper having increased functional surface relative to a conventional fuel rail damper for a given package size.

Even further, what is needed in the art is a fuel rail damper that is constructed in a manner that reduces interference with the fuel rail holders.

Moreover, what is needed in the art is a fuel rail damper that is constructed in a manner that eliminates the need to stamp the shells/faces thereof, and thus more repeatably conforms to the required flatness.

Lastly, what is needed in the art is a fuel rail damper that is less susceptible to degradation and/or failure when exposed to pressure levels higher that exceed the intended pressure range of operation.

SUMMARY OF THE INVENTION

The present invention provides a fuel rail damper.

The invention comprises, in one form thereof, a hollow member having a first end and a second end, opposing first and second sides, and a first face and a second face interconnecting and spacing apart the first and second sides. Each of the first and second ends are sealed in an air tight manner to thereby define a chamber in conjunction with the first and second sides and the first and second faces.

An advantage of the present invention is that only the ends of the fuel rail damper are sealed by welding, and thus substantially less area must be sealed by welding, thus saving time in the welding operation and reducing the susceptibility of the fuel rail damper to leaks due to a defect weld.

A still further advantage of the present invention is that functional surface area is increased relative to a conventional two-piece fuel rail damper of the same overall dimensions. Similarly, the same damping capabilities are achieved in a smaller package size. A further advantage is that the flatted ends resulting from the forming and welding operations can be shaped and used for mounting, locating and anti-rotation with respect to the fuel rail.

An even further advantage of the present invention is that potential interference with the fuel rail holders is reduced.

Yet further, an advantage of the present invention is that susceptibility to degradation and/or failure due to high-magnitude pressure pulsations is reduced.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Generally, and as will be more particularly described hereinafter, the fuel rail damper of the present invention is installed within a fuel rail of an internal combustion engine. The fuel rail damper acts to reduce pressure pulsations that occur within the fuel rail as a result of the operation of fuel injectors in fluid communication with the fuel rail.

Figure 1:
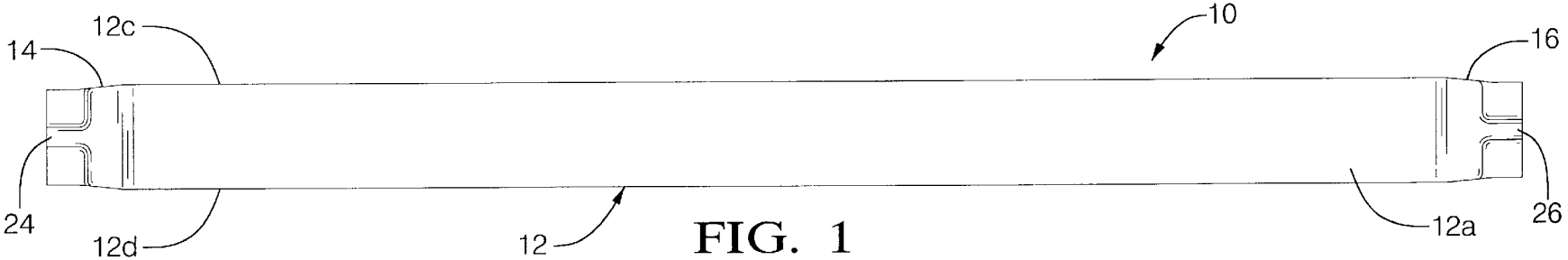
FIG. 1 is a side view of one embodiment of a fuel rail damper of the present invention.
Figure 2:
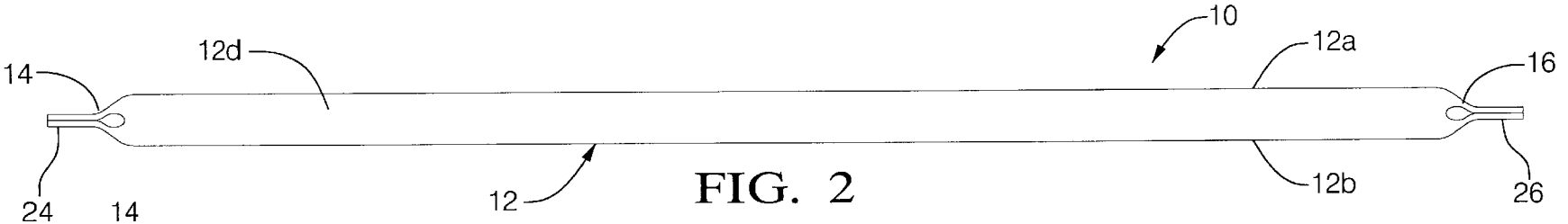
FIG. 2 is a top view of the fuel rail damper of FIG. 1.

Referring now to the drawings, and particularly to FIGS. 1 and 2, there is shown one embodiment of a fuel rail damper of the present invention. Fuel rail damper 10 includes a one-piece, unitary and monolithic hollow member 12 having first end 14 and second end 16. Each of first end 14 and second end 16 are sealed in a fluid and liquid tight manner, such as, for example, by welding, brazing or other suitable means, to thereby define a plenum (not referenced). Hollow member 12 is, for example, substantially rectangular in cross-section. Hollow member 12 includes faces 12*a*, 12*b* and sides 12*c*, 12*d*. Faces 12*a* are relatively wide compared to sides 12*c*, 12*d*. Faces 12*a*, 12*b* are the active portion of fuel rail damper 10, and act to absorb and slow pressure pulsations occurring therein. Hollow member 12 is constructed of, for example, a thermal plastic material, stainless steel, low carbon steel, aluminum, or other suitable material that is substantially impervious to gasoline and/or fuel vapor.

Figure 3:
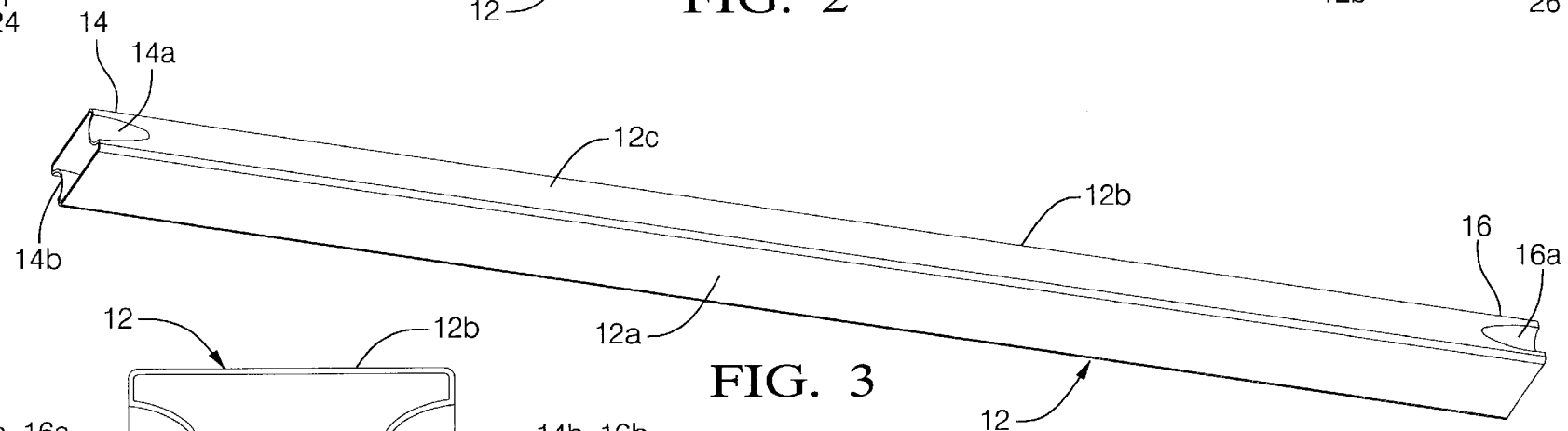
FIG. 3 is a perspective view of the fuel rail damper of FIG. 1 prior to folding and welding of the ends thereof.
Figure 4:
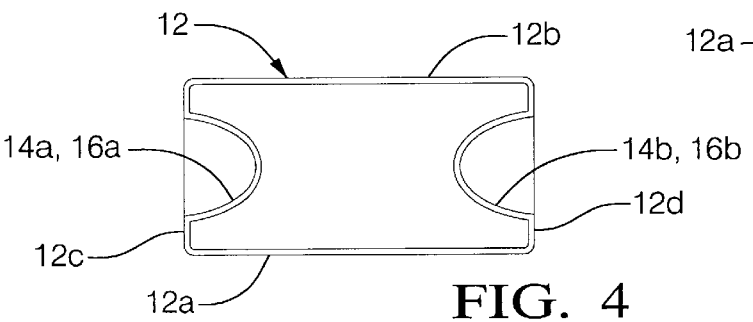
FIG. 4 is an end view of FIG. 3.

Hollow member 12 is a one-piece unitary and monolithic member fabricated by, for example, a rolled weld process, a rolled weld and mandrel drawn process, or extrusion process, of flat stock or round tubing of the raw materials referred to above. As shown in FIGS. 3 and 4, hollow member 12 is then provided at first end 14 and second end 16 with recesses 14*a*, 14*b* and 16*a*, 16*b*, respectively, formed, such as, for example, by stamping or rolling, in sides 12*c* and 12*d*. Each of recesses 14*a*, 14*b* and 16*a*, 16*b*, respectively, are generally wedge-shaped in that the width thereof increases with proximity to a corresponding one of first end 14 and second end 16 (see FIG. 3). In cross-section, each of top and bottom recesses 14*a*, 14*b* and 16*a*, 16*b*, are generally parabolic or conical in shape (see FIG. 4).

As best shown in FIG. 2, first end 14 and second end 16 are pressed together or flattened, such as, for example, by stamping, in the region proximate top and bottom recesses 14*a*, 14*b* and 16*a*, 16*b*, respectively. The pressing or stamping force is applied in a direction that is generally perpendicular to faces 12*a* and 12*b*, and closes first and second ends 14 and 16. Thereafter, first end 14 and second end 16 are fastened together and sealed, such as, for example, by welding, brazing, or other suitable means. Thus, substantially less area requires welding to seal first and second ends 14, 16, respectively, relative to a conventional fuel rail damper which requires the entire periphery thereof be sealed by welding. Sealing the area defined by hollow member 12, first end 14 and second end 16 forms a sealed chamber or plenum (not referenced) within hollow member 12. The flattened or pressed portions of first end 14 and second end 16 form tabs 24, 26 (FIGS. 1 and 2), respectively, which are used for operably mounting fuel rail damper 10, as will be more particularly described hereinafter.

Figure 5:
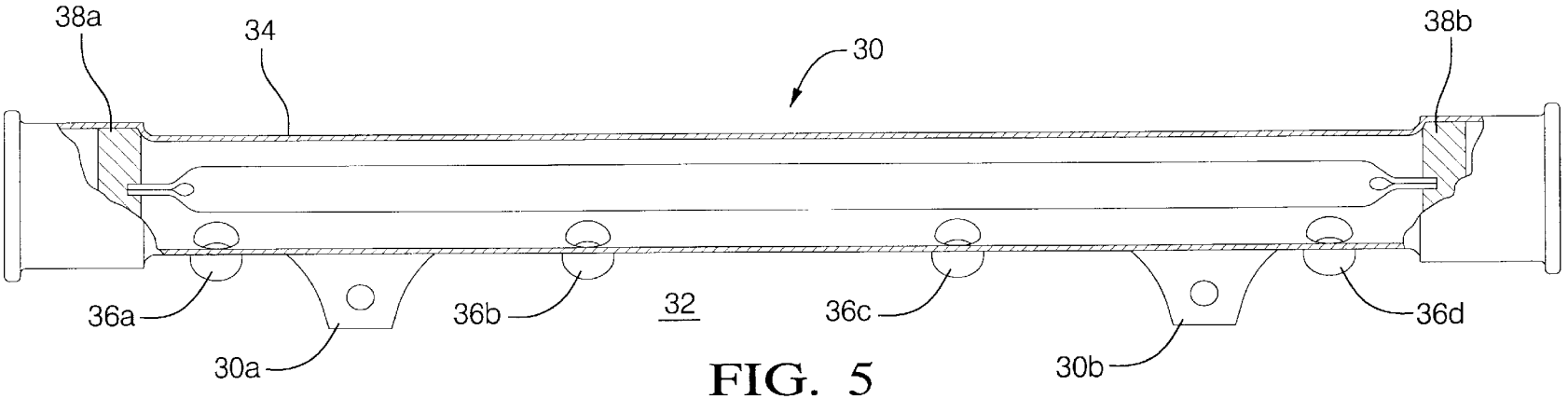
FIG. 5 is a cut-away view of a fuel rail having the fuel rail damper of FIG. 1 operably installed therein.

Referring now to FIG. 5, there is shown one embodiment of a fuel rail of the present invention. Fuel rail 30 includes brackets 30*a*, 30*b* by which fuel rail 30 is operably installed, such as, for example, bolted to internal combustion engine 32. Fuel rail 30 further includes an elongate tubular member 34, which defines a passageway (not referenced) for fuel. Tubular member 34 defines a plurality of fuel injector sockets 36*a*, 36*b*, 36*c*, 36*d*, each of which are in fluid communication with the fuel passageway defined by tubular member 34. Each injector socket 36*a*, 36*b*, 36*c*, 36*d* receives a corresponding fuel injector (not shown). Fuel rail damper 10 is disposed within tubular member 32, and is retained in place by damper holders 38*a*, 38*b*.

In use, fuel rail damper 10 is disposed with fuel rail 30 of internal combustion engine 32. The sequential operation of the fuel injectors, which are supplied with fuel by the fuel rail, create rapid fluctuations in pressure within the fuel rail. The pressure wave created by the pressure fluctuations impact one or both of faces 12*a*, 12*b* of fuel rail 10. Faces 12*a*, 12*b* are compliant and flex as a result of the impacting pressure wave, and thereby at least partially absorb the pressure wave. Further, the compliance of faces 12*a*, 12*b* reduce the velocity of the pressure wave, thereby slowing the wave and reducing the magnitude of the pressure pulsation.

Figure 6:
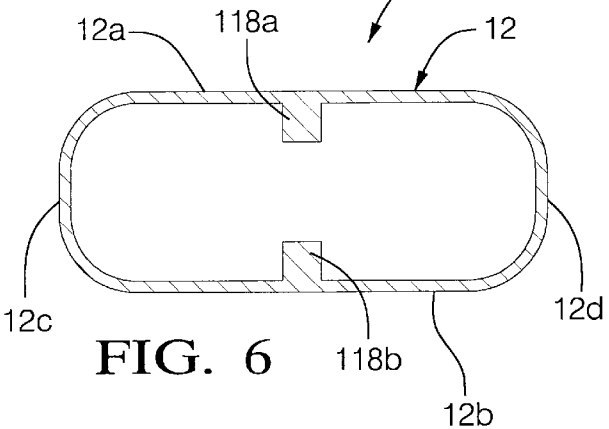
FIG. 6 is a cross-sectional view of a second embodiment of a fuel rail damper of the present invention.

Referring now to FIG. 6, a second embodiment of a fuel rail damper of the present invention is shown. Similar to fuel rail damper 10, fuel rail damper 110 is of one-piece construction. Further, fuel rail damper 110 is constructed from the same or similar materials and processes as discussed above in regard to fuel rail damper 10. However, unlike fuel rail damper 10, fuel rail damper 110 includes stops 118*a*, 118*b* that are affixed, such as, for example, by welding or brazing, to opposing points on the inside surfaces of faces 12*a*, 12*b* of hollow member 12. In use at normal system pressures, faces 12*a*, 12*b* are deflected slightly due to pressure fluctuations within the fuel rail. However, under normal system operating pressures, stops 118*a*, 118*b* will not contact each other as a result of deflection of faces 12*a*, 12*b*. In the event of an abnormally high pressure spike or due to an increase in system pressure beyond the expected/normal operating range, stops 118*a*, 118*b* will contact each other due to the deflection of faces 12*a*, 12*b* resulting from the abnormaly high pressure spike. Stops 118*a*, 118*b* thus conjunctively support and limit the inward displacement of faces 12*a*, 12*b*, respectively, and thereby provide added support to each of faces 12*a*, 12*b*. The additional support reduces the susceptibility of faces 12*a*, 12*b* to cracking and/or developing leaks, and thereby increases the useful life of fuel rail damper 110.

Figure 7:
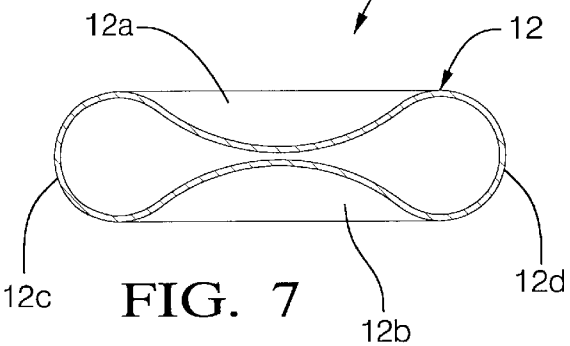
FIG. 7 is a cross-sectional view of a third embodiment of a fuel rail damper of the present invention.

Referring now to FIG. 7, a third embodiment of a fuel rail of the present invention is shown. Fuel rail 210 is also, as discussed above in regard to fuel rail damper 10, of one-piece construction. Further, fuel rail damper 210 is constructed from the same or similar materials and processes as discussed above in regard to fuel rail damper 10. However, faces 12*a*, 12*b* of fuel rail damper 210 are concave in shape relative to the exterior of the sealed chamber or plenum, and are convex in shape relative to the interior of the sealed chamber or plenum. Thus, the cross-section of fuel rail damper 210 is shaped generally similarly to a figure eight. More particularly, due to the concavity of faces 12*a*, 12*b*, the cross-sectional area of fuel rail damper 210 is relatively large proximate to each of sides 12*c* and 12*d*, and decreases therefrom toward a relatively small cross-section proximate the midpoint of faces 12*a*, 12*b*. The narrowed cross section places the middle portions of faces 12*a* and 12*b* in closer proximity relative to each other. Thus, the displacement of faces 12*a* and/or 12*b* as a result of high-magnitude pressure spike or level is limited, and added support is provided to each of faces 12*a*, 12*b*. The additional support reduces the susceptibility of faces 12*a*, 12*b* to cracking and/or developing leaks, and thereby increases the useful life of fuel rail damper 210.

Figure 8:
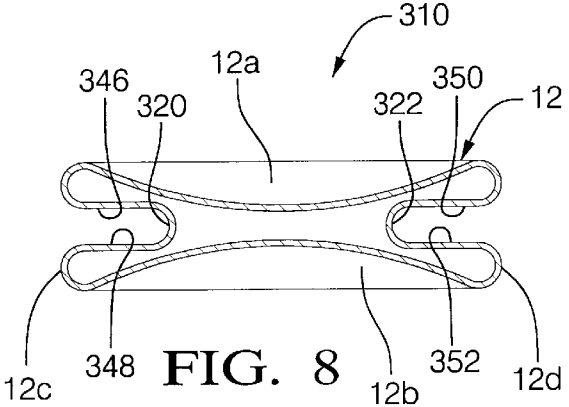
FIG. 8 is a cross-sectional view of a fourth embodiment of a fuel rail damper of the present invention.

Referring now to FIG. 8, a fourth embodiment of a fuel rail of the present invention is shown. Fuel rail 310 is, as discussed above in regard to fuel rail damper 10, of one-piece construction. Further, fuel rail damper 310 is constructed from the same or similar materials and processes as discussed above in regard to fuel rail damper 10. However, fuel rail 310 includes, in addition to concave outer surfaces of faces 12*a*, 12*b* as described above in regard to fuel rail 210, respective grooves 320 and 322 formed in sides 12*c* and 12*d* . Grooves 320, 322 act to limit the inward displacement or flexing of faces 12*a*, 12*b*, in a manner substantially similar to stops 118*a*, 118*b* of fuel rail damper 110 as described above. Further, grooves 320, 322 provide additional damping capacity to fuel rail damper 310. Groove walls 346, 348 and 350, 352 flex, and thereby allow faces 12*a*, 12*b*, respectively, to also flex and act as springs. Thus, grooves 320, 322 limit the displacement of faces 12*a* and/or 12*b* as a result of high-magnitude pressure pulsations, provide added support to each of faces 12*a*, 12*b*, and enable faces 12*a*, 12*b* to flex and act as springs. The ability of faces 12*a*, 12*b* to flex increases the overall damping capacity of fuel rail damper 310, and the additional support reduces the susceptibility of faces 12*a*, 12*b* to cracking and/or developing leaks, thereby increasing the useful life of fuel rail damper 310.

In the embodiments shown, hollow member 12 is substantially rectangular in cross section (FIGS. 3 and 4). However, it is to be understood that hollow member 12 can be alternately configured, such as, for example, with an oval or generally rectangular cross section.

In the embodiments shown, stops 118*a*, 118*b* are affixed to opposing points on the inside surface of faces 12*a*, 12*b*. However, it is to be understood that stops 118*a*, 188*b* can be alternately configured, such as, for example, integral with the inside surfaces of faces 12*a*, 12*b*. Further, stops 118*a*, 118*b* can be alternately configured to extend a predetermined length and have a predetermined width along the inside surfaces of faces 12*a*, 12*b*.

In the embodiments shown, fuel rail 30 includes four injector sockets 36*a–d*. However, it is to be understood that fuel rail 30 can be alternately configured, such as, for example, with six, eight or a varying number of fuel injector sockets.

In the embodiments shown, first and second ends 14, 16 are stamped flat and extend in a generally parallel manner relative to hollow member 12. However, it is to be understood that first and second ends 14, 16 can be alternately configured, such as, for example, stamped flat and then folded over and back in a direction toward one of faces 12*a*, 12*b*.

In the embodiments shown, the fuel rail damper of the present invention includes various features such as stops 118*a*, 118*b* that prevent yielding and/or deformation of the fuel rail damper. However, it is to be understood that the fuel rail damper of the present invention can be alternately configured, such as, for example, filled at least partially with a low-density foam or other suitable material. The low density foam or other suitable material must compress relatively easily under normal operating conditions, while providing a greater resistance per unit length to compression during an over pressure event and thereby support the damping surfaces or faces.

In the embodiments shown, the various features, such as stops 118*a*, 118*b*, are incorporated into the one-piece fuel rail damper of the present invention. However, it is to be understood that the various features, such as stops 118*a*, 118*b*, grooves 320, 322, and concave faces can be incorporated within a conventional, two-piece fuel rail damper.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A fuel rail damper, comprising:

a hollow member having a first end and a second end;

opposing first and second sides;

a first face and a second face interconnecting and spacing apart said first side and said second side;

each of said first and second ends sealed in an air tight manner to thereby define a chamber in conjunction with said first and second sides and said first and second faces; and at least one stop disposed within said chamber.

2. The fuel rail damper of claim 1, wherein said hollow member comprises a one-piece unitary and monolithic hollow member.

3. The fuel rail damper of claim 1, wherein at least one of said first and second ends define respective tabs for mounting said fuel rail damper within a fuel rail.

4. The fuel rail damper of claim 1, wherein each of said at least one stop is affixed to an inside surface of a corresponding one of said first face and said second face.

5. The fuel rail damper of claim 1, wherein each of said at least one stop is integral and monolithic with a corresponding one of said first face and said second face.

6. The fuel rail damper of claim 1, wherein at least one of said first and second faces is concave in shape relative to an exterior of said chamber.

7. The fuel rail damper of claim 1, wherein at least one of said first and second sides is concave in shape relative to an exterior of said chamber.

8. The fuel rail damper of claim 1, wherein said stop comprises a concave region formed in at least one of said first and second faces.

9. The fuel rail damper of claim 1, wherein said stop comprises generally opposing concave regions formed in each of said first and second faces.

10. A fuel rail damper, comprising:

a hollow member having a first end and a second end;

opposing first and second sides;

a first face and a second face interconnecting and spacing apart said first side and said second side;

each of said first and second ends sealed in an air tight manner to thereby define a chamber in conjunction with said first and second sides and said first and second faces; and at least one of said first and second faces is concave in shape relative to an exterior of said chamber, and at least one of said first and second sides is concave in shape relative to an exterior of said chamber.

11. A fuel rail damper, comprising:

a hollow member having a first end and a second end;

opposing first and second sides;

a first face and a second face interconnecting and spacing apart said first side and said second side;

each of said first and second ends sealed in an air tight manner to thereby define a chamber in conjunction with said first and second sides and said first and second faces; and a groove formed in at least one of said first and second sides.

12. A fuel rail, comprising:

an elongate tubular member defining a passageway for fluid, a plurality of injector sockets defined by said tubular member, each of said plurality of injector sockets in fluid communication with said passageway said tubular member configured for being fluidly connected to a fuel supply;

a fuel rail damper including hollow member disposed within said passageway, said hollow member having a first end and a second end, opposing first and second sides, a first face and a second face interconnecting and spacing apart said first side and said second side, each of said first and second ends sealed in an air tight manner to thereby define a chamber in conjunction with said first and second sides and said first and second faces; and at least one stop disposed within said chamber.

13. The fuel rail of claim 12, wherein said hollow member comprises a one-piece unitary and monolithic hollow member.

14. The fuel rail damper of claim 12, wherein each of said at least one stop is affixed to an inside surface of a corresponding one of said first face and said second face.

15. The fuel rail damper of claim 12, wherein each of said at least one stop is integral and monolithic with a corresponding one of said first face and said second face.

16. The fuel rail damper of claim 12, wherein at least one of said first and second faces is concave in shape relative to an exterior of said chamber.

17. The fuel rail damper of claim 13, wherein at least one of said first and second sides is concave in shape relative to an exterior of said chamber.

18. A fuel rail, comprising:

an elongate tubular member defining a passageway for fluid, a plurality of injector sockets defined by said tubular member, each of said plurality of injector sockets in fluid communication with said passageway said tubular member configured for being fluidly connected to a fuel supply;

a fuel rail damper including hollow member disposed within said passageway, said hollow member having a first end and a second end, opposing first and second sides, a first face and a second face interconnecting and spacing apart said first side and said second side, each of said first and second ends sealed in an air tight manner to thereby define a chamber in conjunction with said first and second sides and said first and second faces; and at least one of said first and second faces is concave in shape relative to an exterior of said chamber, and at least one of said first and second sides is concave in shape relative to an exterior of said chamber.

19. A fuel rail, comprising:

an elongate tubular member defining a passageway for fluid, a plurality of injector sockets defined by said tubular member, each of said plurality of injector sockets in fluid communication with said passageway said tubular member configured for being fluidly connected to a fuel supply;

a fuel rail damper including hollow member disposed within said passageway, said hollow member having a first end and a second end, opposing first and second sides, a first face and a second face interconnecting and spacing apart said first side and said second side, each of said first and second ends sealed in an air tight manner to thereby define a chamber in conjunction with said first and second sides and said first and second faces; and a groove formed in at least one of said first and second sides.

20. An internal combustion engine having a fuel rail, said fuel rail including:

an elongate tubular member defining a passageway for fluid, a plurality of injector sockets defined by said tubular member, each of said plurality of injector sockets in fluid communication with said passageway, said tubular member configured for being fluidly connected to a fuel supply;

a fuel rail damper including a one-piece elongate, unitary and monolithic hollow member disposed within said passageway, said hollow member having a first end and a second end, opposing first and second sides, a first face and a second face interconnecting and spacing apart said first side and said second side, each of said first and second ends sealed in an air tight manner to thereby define a chamber in conjunction with said first and second sides and said first and second faces; and at least one stop disposed within said chamber.

* * * * *